US007078143B2

(12) United States Patent
Hashimoto et al.

(10) Patent No.: US 7,078,143 B2
(45) Date of Patent: Jul. 18, 2006

(54) ELECTROPHOTOGRAPHIC PHOTORECEPTOR AND METHOD FOR PRODUCING THE SAME

(75) Inventors: Masaki Hashimoto, Yamatokoriyama (JP); Kazushige Morita, Ikoma-gun (JP); Mikio Kakui, Ikoma-gun (JP); Yuji Tanaka, Yao (JP); Masayuki Sakamoto, Nabari (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/627,719

(22) Filed: Jul. 28, 2003

(65) Prior Publication Data

US 2004/0053151 A1 Mar. 18, 2004

(30) Foreign Application Priority Data

Sep. 13, 2002 (JP) ..... P2002-268963

(51) Int. Cl.
*G03G 5/10* (2006.01)

(52) U.S. Cl. ..... 430/131; 430/69; 430/133

(58) Field of Classification Search ..... 430/69, 430/131, 133; 399/159; 347/131
See application file for complete search history.

(56) References Cited

U.S. PATENT DOCUMENTS 6,239,824 B1 * 5/2001 Mutou et al. ..... 347/131

FOREIGN PATENT DOCUMENTS

| | | | |
|---|---|---|---|
| JP | 02-103556 | * | 4/1990 |
| JP | 4-336540 | A | 11/1992 |
| JP | 2000-356859 | A | 12/2000 |
| JP | 2001-027815 | * | 1/2001 |

OTHER PUBLICATIONS

Japanese Patent Office machine-assisted English language translation of JP2001-027815 (Pub. Jan. 2001).*
USPTO English-language translation of JP 02-103556 (pub. Apr. 1990).*

* cited by examiner

*Primary Examiner*—Janis L. Dote
(74) *Attorney, Agent, or Firm*—Nixon & Vanderhye P.C.

(57) ABSTRACT

The object of the invention is to prevent interference fringes of images and allow precise measurement of the thickness of a layer by the optical interferometry by limiting the surface roughness of a conductive substrate. The surface roughness of the conductive substrate provided in an electrophotographic photoreceptor is such that the maximum peak-to-valley roughness height (Ry)=0.8 to 1.4 μm, the centerline average roughness (Ra)=0.10 to 0.15 μm, the ten-point average roughness (Rz)=0.7 to 1.3 μm, the average peak-to-peak distance (Sm)=5 to 30 μm, and the peak count Pc=60 to 100. In such an electrophotographic photoreceptor, light for exposure can be scattered to an appropriate extent, so that interference fringes can be prevented, and an interference pattern is formed during measurement of the thickness of the photosensitive layer by the optical interferometry so that the thickness of the layer can be measured with a high precision.

1 Claim, 12 Drawing Sheets

FIG. 2

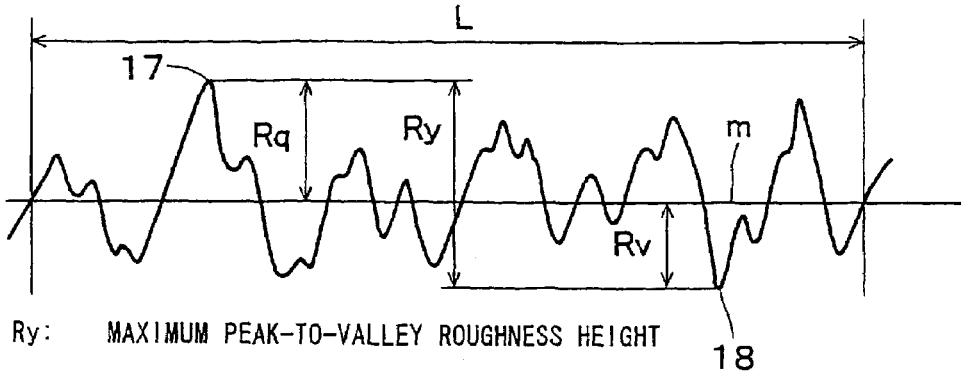

Ry: MAXIMUM PEAK-TO-VALLEY ROUGHNESS HEIGHT m: AVERAGE LINE

L: REFERENCE LENGTH

FIG. 3

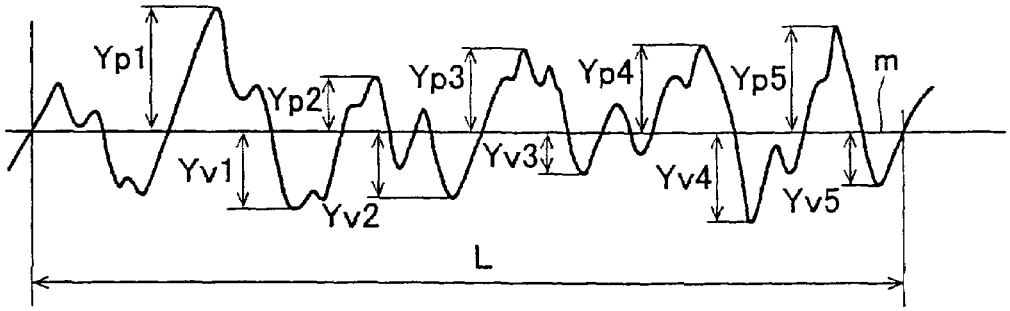

$$Rz = ( | Yp1+Yp2+Yp3+Yp4+Yp5 | + | Yv1+Yv2+Yv3+Yv4+Yv5 | )/5$$

Yp1, Yp2, Yp3, Yp4, Yp5: HEIGHT OF THE HIGHEST PEAK TO THE 5TH HIGHEST PEAK IN A TAKEN-OUT PORTION CORRESPONDING TO REFERENCE LENGTH L

Yv1, Yv2, Yv3, Yv4, Yv5: HEIGHT OF THE DEEPEST VALLEY TO THE 5TH DEEPEST VALLEY IN A TAKEN-OUT PORTION CORRESPONDING TO REFERENCE LENGTH L

Rz: TEN-POINT AVERAGE ROUGHNESS m: AVERAGE LINE

L: REFERENCE LENGTH

ELECTROPHOTOGRAPHIC PHOTORECEPTOR AND METHOD FOR PRODUCING THE SAME

BACKGROUND OF THE INVENTION

1. Field of the Invention

The present invention relates to an electrophotographic photoreceptor and a method for producing the same.

2. Description of the Related Art

Conventionally, in an electrophotographic image forming process in an electrophotographic application apparatus such as copiers and laser printers, gas lasers having a comparatively short wavelength such as He—Ne lasers, Ar lasers, and He—Cd lasers have been used as light to which a surface of an electrophotographic photoreceptor is exposed so as to form electrostatic latent images. CdS, ZnO, Se or the like, which forms a thick layer, has been used for a photosensitive layer of an electrophotographic photoreceptor that can be used with such a gas laser. Therefore, light for exposure with which the electrophotographic photoreceptor is irradiated by the gas laser is completely absorbed by the thick photosensitive layer, so that interference caused by reflection on the substrate surface of the electrophotographic photoreceptor did not occur.

In recent years, instead of the gas lasers, semiconductor lasers or light-emitting diodes (abbreviated as "LED") that are compact and inexpensive have been increasingly used as a light source to which an electrophotographic photoreceptor is exposed. With the transition of the light source to be used, electrophotographic photoreceptors having photosensitivity to light having a long wavelength of 700 nm or more that is emitted from the semiconductor lasers or LEDs have been used. For example, multilayered electrophotographic photoreceptors having a multilayered structure in which a charge generating layer comprising a phthalocyanine pigment such as copper phthalocyanine or aluminum chloride phthalocyanine and a charge conveying layer are laminated have been used.

When the electrophotographic photoreceptors having photosensitivity to light having a long wavelength are mounted in an electrophotographic printer of a laser beam scanning system and is exposed to a laser beam, non-uniformity in the images with a pattern of interference fringes may occur in the formed images. The non-uniformity in the images with a pattern of interference fringes occurs partly because the laser light having a long wavelength is not completely absorbed by the photosensitive layer, and the light transmitted through the photosensitive layer reaches the substrate surface of the electrophotographic photoreceptor and is reflected. Then, the reflected light is multiple-reflected in the photosensitive layer and thus becomes a coherent light, resulting in interference fringes.

One approach to prevent such interference fringes that cause non-uniformity in the images is to produce roughness on the substrate surface of the electrophotographic photoreceptor. FIGS. 15A and 15B are views showing the manner in which light is reflected on a substrate surface. FIG. 15A shows the manner in which light is reflected on a smooth substrate surface 1. Incident light beams L11, L12 and L13 are reflected regularly on the smooth substrate surface 1. Since the thickness T1 of a photosensitive layer 2 formed on the smooth substrate surface 1 is formed uniformly, the light beams L11, L12, and L13 reflected on the substrate surface 1 are also reflected regularly on the surface of a photosensitive layer 2. Therefore, in the case where the substrate surface 1 is smooth, the light beams L11, L12, and L13 having a matched phase are multiple-reflected and are mutually intensified (weakened) so as to form an interference pattern. Thus, interference fringes also occur in images formed on the surface of the photoreceptor.

FIG. 15B shows the manner in which light is reflected on a rough substrate surface 3. On the rough substrate surface 3, incident light beams L21, L22 and L23 are reflected irregularly and scattered in different directions from each other. The thickness of a photosensitive layer 4 formed on the rough substrate surface 3 is different from portion to portion, for example, as shown in T21 or T22 of FIG. 15B, and therefore although the light beams L21, L22, and L23 reflected irregularly on the substrate surface 3 are reflected regularly on the surface of the photosensitive layer 4, their phases are different. Consequently, in the case where the substrate surface 3 is rough, no interference pattern due to the light beams L21, L22, and L23 is formed, so that it is prevented interference fringes from occurring in the images formed on the surface of the photoreceptor.

In general, the photosensitive layer of an electrophotographic photoreceptor is often formed by an immersing and coating method in which a substrate is immersed in a coating bath filled with a photoreceptor coating solution, and then the substrate is lifted at a predetermined rate, because of high productivity. In this immersing and coating method, when lifting the substrate, stripes are generated in the direction opposite to the lifting direction, so that non-uniformity in the thickness tends to be generated. In addition, an organic solvent that easily evaporates is contained in the coating solution, so that only the solvent evaporates from the coating solution in the coating bath and the viscosity and the concentration of the coating solution is changed. As a result, the thickness during coating is unstable.

For prevention of non-uniform thickness and stable formation of uniform thickness, the thickness of the layer is measured with a high precision in the course of coating and forming the photosensitive layer on a substrate, and the amount of coating is controlled in accordance with the measurement results so as to adjust the thickness. For this purpose, various methods for measuring the thickness of the photosensitive layer are proposed. As the methods for measuring the thickness, contact methods for measuring a film thickness with a step height meter, an eddy current meter for measuring a film thickness or the like, and non-contact methods for measuring a film thickness such as a color and color-difference method, optical interferometry, and an optical absorption method are used, but optical interferometry is most commonly used because operation is comparatively simple, and measurement can be performed in a short time (e.g., see Japanese Unexamined Patent Publication JP-A 4-336540 (1992, page 4, FIG. 2)).

Hereinafter, the principle on which the thickness of a layer is measured by optical interferometry will be described briefly. FIGS. 16A and 16B are views showing reflection behavior of light in transparent film 5 and 7, respectively. FIG. 16A shows the manner in which a light beam L31 incident to the transparent film 5 is multiple-reflected in the transparent film 5. The light measured as a reflected light beam L32 from a surface 5*a* of the transparent film 5 is a light beam obtained by synthesizing light beams that are multiple-reflected in the transparent film 5. Light is a wave, so that when synthesizing light beams, if a phase difference is an integer multiple of 2 $\pi$, the light beams are mutually intensified, and if a phase difference is an odd integer multiple of $\pi$, the light beams are canceled each other and interference occurs.

FIG. 16B shows the manner in which light is reflected in the transparent film 7 formed on the substrate 6. The reflectance R of the light in the transparent film 7 formed on the substrate 6 can be obtained based on Equation (1):

$$\text{Reflectance } R=\{R1^2+R2^2-2R1R2\cos(X)\}/\{1+R1^2+R2^2-2R1R2\cos(X)\} \quad (1)$$

where X=4 πN1d/λ

λ: wavelength of light d: thickness of a transparent film

R1: reflectance on a surface of a transparent film

R2: reflectance on a surface of a substrate

N1: refractive index of a transparent film

N2: refractive index of a substrate where N2>N1.

The reflectance R1 in the surface 7*a* of the transparent film and the reflectance R2 in the surface 6*a* of the substrate can be obtained based on Equations (2) and (3), respectively.

$$R1=(1-N1)/(1+N1) \quad (2)$$

$$R2=(N1-N2)/(N1+N2) \quad (3)$$

The reflectance R becomes the largest value (or the smallest value) in a wavelength with which light beams are mutually intensified (or weakened) by optical interference, so that when the reflectance R is differentiated with a wavelength λ to obtain a wavelength that provides the largest (or the smallest) reflectance R, Equation (4) can be obtained.

$$(1/\lambda n)-(1/\lambda n+1)=\tfrac{1}{2}N1d \quad (4)$$

where λn: a wavelength having the $n^{th}$ largest value (or smallest value).

When the wavelength with which light beams are mutually intensified (or weakened) and the refractive index are known, the thickness d of the transparent film 7 can be obtained based on Equation (4). The refractive index of the film and the wavelength can be measured with, for example, a spectrophotometer, and therefore the thickness of the film can be obtained with the measurement results based on the Equation (4). For a film whose refractive index is not known, a film having a defined thickness is formed and the refractive index of the film whose thickness is known is obtained based on Equation (4) in advance, so that an arbitrary thickness of a film formed of the same material can be obtained.

Thus, the optical interferometry measures the thickness of a photosensitive layer utilizing an interference pattern of light that is multiple-reflected in the photosensitive layer of an electrophotographic photoreceptor. Therefore, when the surface of the substrate of the electrophotographic photoreceptor is made rough to prevent interference fringes that cause non-uniformity in the images so as to weaken the interference based on reflection on the substrate surface and the surface of the photosensitive layer, it becomes difficult to measure the thickness of the photosensitive layer.

In order to solve such a problem, light having a wavelength longer than a surface roughness of the substrate shown in the ten-point average roughness (Rz) defined in Japanese Industrial Standard (JIS) B0601 is used as the light used for measuring the thickness of the photosensitive layer to suppress disappearance of the peak during synthesis of light beams so that the thickness can be measured even with weak interference (e.g., Japanese Unexamined Patent Publication JP-A 2000-356859 (2000, page 4, FIG. 6).

However, the technique disclosed in JP-A 2000-356859 also has the following problem. With higher resolution of an image forming apparatus, the spot diameter of light for writing electrostatic latent images on the surface of the electrophotographic photoreceptor has been increasingly reduced. When the spot diameter of light is reduced, the interference fringes may occur, regardless of the rough surface of the substrate of the electrophotographic photoreceptor. Therefore, when the spot diameter of light is small, the surface roughness of the substrate tends to be made rougher in order to prevent interference fringes from occurring, and light having a longer wavelength is used as the light used for measuring the thickness as the surface roughness becomes rougher. Thus, when the wavelength of light used for measuring the thickness becomes longer, the distance between adjacent wavelengths is increased, so that the measurement precision of the thickness is reduced, or the measurement cannot be performed.

SUMMARY OF THE INVENTION

An object of the invention is to provide an electrophotographic photoreceptor in which interference fringes of images are prevented from occurring by limiting the surface roughness of a conductive substrate and the thickness of the layer can be measured with high precision by optical interferometry, and a method for producing the same.

The inventors of the invention conducted careful observation with respect to images in which dark and light stripes that seem to be caused by the multiple reflection in the photosensitive layer are generated and images with no dark and light stripes of the images formed by various electrophotographic photoreceptors and various image forming apparatuses provided therewith. As a result, it was found that although there is a correlation between the surface roughness of the substrate and the occurrence of the dark and light stripes, the relationship between the surface roughness and the occurrence of the dark and light stripes cannot be clarified only with the maximum peak-to-valley roughness height (Ry), the centerline average roughness (Ra), the ten-point average roughness (Rz) and the average peak-to-peak distance (Sm), which is the average of the peak-to-peak distance of the cross-sectional curve, which are commonly used indices of the surface roughness and defined in JIS B0601-1994.

That is to say, it is known that the interference fringes (dark and light stripes in images) caused by multiple reflection in the photosensitive layer in an electrophotographic process using coherent light are affected by the surface roughness of the substrate and the fine waveform shape, and an effect of suppressing occurrence of the interference fringes can be obtained by setting Ry, Ra, Rz and Sm of the substrate surface to a predetermined size (roughness) or more to make the surface be rough.

However, for interference fringes occurring in the images formed in an image forming apparatus having a small light spot, it is difficult to correlate the occurrence of the interference fringes and the surface roughness only with Ry, Ra, Rz and Sm. However, in addition to Ry, Ra, Rz and Sm, a peak count Pc obtained by counting the number of peaks having a height equal to or more than a predetermined width from the top point to the bottom point in the reference length that is the predetermined measurement distance is introduced, so that the correlation between the occurrence of the interference fringes and the surface roughness can be clarified. Moreover, the occurrence of the interference fringes is prevented by limiting Ry, Ra, Rz, Sm and Pc to be within a preferable range, so that it is possible to measure the thickness of the layer with high precision by the optical interferometry in an area having a rough surface roughness. The inventors of the invention obtained this knowledge and arrived at the invention.

The invention is directed to an electrophotographic photoreceptor comprising a conductive substrate and a photosensitive layer on the conductive substrate and being exposed to coherent light, wherein surface roughness of the conductive substrate is such that maximum peak-to-valley roughness height (Ry), centerline average roughness (Ra), ten-point average roughness (Rz) and average peak-to-peak distance that is an average of a peak-to-peak distance of a cross-sectional curve (Sm) satisfy:

(a) Ry=0.8 to 1.4 μm, (b) Ra=0.10 to 0.15 μm, (c) Rz=0.7 to 1.3 μm, and (d) Sm=5 to 30 μm, and peak count Pc satisfies:

(e) Pc=60 to 100.

According to the invention, the surface roughness of the conductive substrate of the electrophotographic photoreceptor can be limited to the preferable range using Pc as well as Ry, Ra, Rz, and Sm as the indices thereof. This realizes an electrophotographic photoreceptor in which inference fringes of the images caused by the multiple-reflection of light in the photosensitive layer formed on the conductive substrate can be prevented from occurring, and the thickness of the layer can be measured by the optical interferometry with high precision. Herein, the peak count Pc is an index of the surface roughness according to a parameter PPI defined in J911-1986 of the Society of Automotive Engineers (SAE) Standard and is a value obtained by counting the number of peaks having a height of at least the predetermined width of the top point and the bottom point in the reference length as described above.

The invention is also directed to a method for producing an electrophotographic photoreceptor in which a charge generating layer and a charge conveying layer, or an underlying layer, a charge generating layer and a charge conveying layer, are formed on a conductive substrate by sequentially coating, the method comprising:

preparing the conductive substrate in which maximum peak-to-valley roughness height (Ry), centerline average roughness (Ra), ten-point average roughness (Rz) and average peak-to-peak distance that is an average of a peak-to-peak distance of a cross-sectional curve (Sm) satisfy:

(a) Ry=0.8 to 1.4 μm, (b) Ra=0.10 to 0.15 μm, (c) Rz=0.7 to 1.3 μm, and (d) Sm=5 to 30 μm, and peak count Pc satisfies:

(e) Pc=60 to 100;

sequentially measuring thicknesses of the layers by optical interferometry when the coating is performed to form the layers on the conductive substrate, feeding back measurement results to controlling means, and controlling an amount of coating by an output from the controlling means in accordance with the measurement results so as to adjust the thicknesses of the layers.

According to the invention, the conductive substrate whose surface roughness is limited to the preferable range using Pc as well as Ry, Ra, Rz, and Sm as the indices of the surface roughness is prepared, the thickness of the layers is measured by optical interferometry when the coating is performed to form the layers constituting the photosensitive layer on the conductive substrate, measurement results are fed back, and an electrophotographic photoreceptor is produced while the thickness of the layers are adjusted. Thus, the surface roughness of the conductive substrate is in the preferable range and the thickness of the layers can be measured with good precision by optical interferometry, so that when coating and forming the layers constituting the photosensitive layer, the thickness of the layers can be formed stably, and non-uniformity in the thickness can be prevented. Furthermore, an electrophotographic photoreceptor can be produced in which the thickness precision of the photosensitive layer is excellent, and interference fringes do not occur.

Furthermore, the invention is directed to an image forming apparatus comprising an electrophotographic photoreceptor mentioned above and an exposure apparatus for conducting image-exposure at a pixel density of 1200 dpi or more so as to form electrostatic a latent image on a surface of the electrophotographic photoreceptor.

According to the invention, the image forming apparatus includes the electrophotographic photoreceptor having the conductive substrate whose surface roughness is limited to the preferable range using Pc as well as Ry, Ra, Rz, and Sm as the indices of the surface roughness and the exposure apparatus that performs image-exposure on the surface of the electrophotographic photoreceptor at a pixel density of 1200 dpi or more so as to form electrostatic latent images. Thus, electrostatic latent images can be formed on the electrophotographic photoreceptor including the conductive substrate having the preferable surface roughness with light having a small spot diameter, so that an image forming apparatus can be realized in which inference fringes of images can be prevented from occurring, and high resolution and good quality images can be formed.

In the invention, it is preferable that the exposure apparatus emits laser light having a wavelength of 780 nm.

BRIEF DESCRIPTION OF THE DRAWINGS

Other and further objects, features, and advantages of the invention will be more explicit from the following detailed description taken with reference to the drawings wherein:

FIG. 2 is a diagram for illustrating the definition of the maximum peak-to-valley roughness height Ry;

FIG. 3 is a diagram for illustrating the definition of the ten-point average roughness Rz;

DETAILED DESCRIPTION OF THE PREFERRED EMBODIMENTS

Figure 1A:
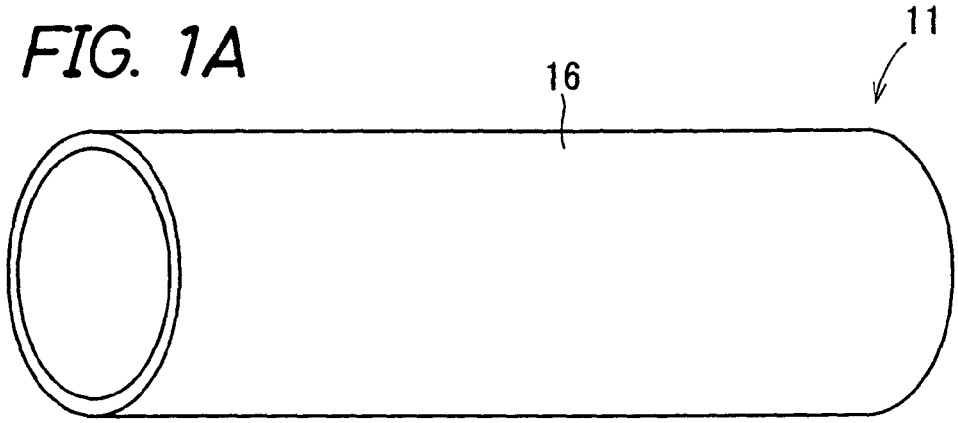
FIGS. 1A and 1B are schematic views showing simplified structures of an electrophotographic photoreceptor of an embodiment of the invention.

Now referring to the drawings, preferred embodiments of the invention are described below.

Figure 1B:
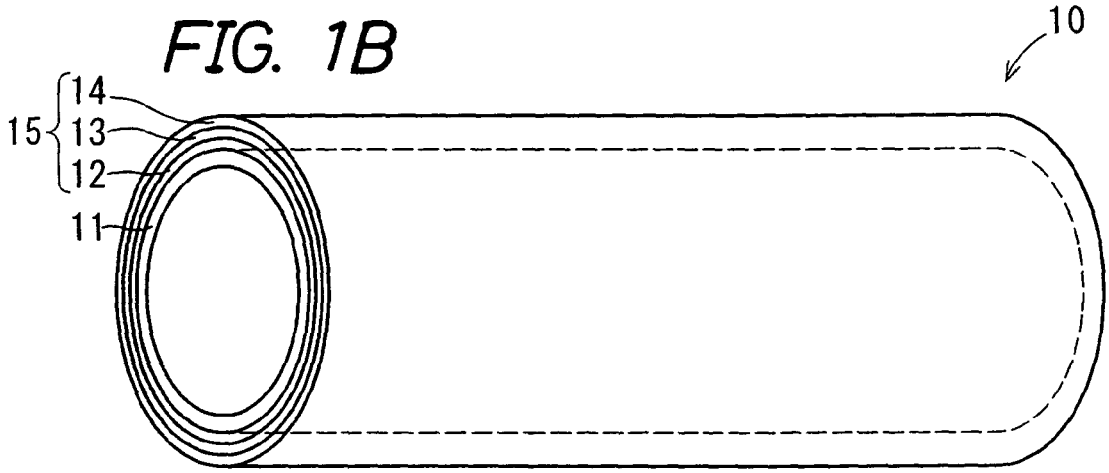

FIGS. 1A and 1B are schematic views showing simplified structures of an electrophotographic photoreceptor 10 of an embodiment of the invention. The electrophotographic photoreceptor 10 (hereinafter, referred to simply as "photoreceptor") includes a conductive substrate 11 made of a material having conductivity, an underlying layer 12 formed on the outer circumferential surface of the conductive substrate 11, a charge generating layer 13 formed on the outer circumferential surface of the underlying layer 12, and a charge conveying layer 14 formed on the outer circumferential surface of the charge generating layer 13. Here, the underlying layer 12, the charge generating layer 13, and the charge conveying layer 14 constitute a photosensitive layer 15.

The conductive substrate 11 shown in FIG. 1A has a cylindrical shape and is made of a metal such as aluminum, copper, stainless steel or brass. The conductive substrate 11 is not necessarily made of a metal, and can be a cylindrical member such as a polyester film or paper on which a metal film such as an aluminum alloy or a film of a conductive material such as indium oxide is formed. The conductive substrate 11 is formed such that the surface roughness of the outer circumferential surface 16 satisfies the following range. Ry, Ra, Rz and Sm that are defined in JIS B0601-1994 are in the following ranges. (a) Ry=0.8 to 1.4 μm, (b) Ra=0.10 to 0.15 μm, (c) Rz=0.7 to 1.3 μm, and (d) Sm=5 to 30 μm. The peak count Pc according to a parameter PPI defined in SAE J911-1986 is in the range of (e) Pc=60 to 100.

A method for finishing the surface of the conductive substrate 11 so as to have the surface roughness can be any one of the following: methods for mechanically making the surface be rough such as cutting, honing, etching, dropping/colliding a rigid ball, contact pressing of a cylinder having irregularities, grinding, laser irradiation, and high pressure water spraying, or method for making roughness with an oxidization treatment such as anode oxidization, boehmite treatment, and heating and oxidization treatment. For example, in cutting process, which is a mechanical method, the surface roughness whose index values are in the above-described ranges can be obtained by selecting the material of a cutting tool, the shape of the blade of a cutting tool, the travel speed of a cutting tool, and the type of a lubricant as appropriate. Hereinafter, the reason why these ranges of the index values of the surface roughness are preferable will be described.

(a) The maximum peak-to-valley roughness height Ry=0.8 to 1.4 μm: FIG. 2 is a diagram for illustrating the definition of the maximum peak-to-valley roughness height Ry. Ry is the sum (Ry=Rq+Rv) of the height Rq of a peak 17 having the largest height and the depth Rv of a valley 18 having the largest depth in a portion with a reference length L taken in the direction to which an average line m is extended from the cross-sectional curve (called a roughness curve after cut-off. In general, since a large swell of a wavelength is often cut off, the curve of the measurement results is referred to as a roughness curve in the following) indicating the measurement results of the surface roughness. Herein, the height and the depth are distances in the direction orthogonal to the average line m.

When Ry is less than 0.8 μm, interference fringes due to the reflected light of the conductive substrate surface 16 are generated. When Ry exceeds 1.4 μm, the rough conductive substrate surface 16 functions as a carrier injecting portion to the photosensitive layer 15, so that white spots in a black portion or black spots in a while portion may be generated during image formation. Therefore, Ry was set to 0.8 to 1.4 μm.

(b) Centerline average roughness Ra=0.10 to 0.15 μm: Ra is the average of the absolute values of deviations from the average line m to the roughness curve. Ra is given by Equation (5) below when taking the average line m as the X axis, and the axis in the direction orthogonal to the average line m as the Y axis, and representing the roughness curve y as y=f(x).

$$Ra = \frac{1}{L}\int_0^L |f(x)|\,dx \tag{5}$$

When Ra is less than 0.10 μm, the incidence rate of interference fringes is increased, and when Ra exceeds 0.15 μm, it becomes difficult to measure the thickness of the layer by optical interferometry. Therefore, Ra was set to 0.10 to 0.15 μm.

(c) Ten-point average roughness Rz=0.7 to 1.3 μm: FIG. 3 is a diagram for illustrating the definition of the ten-point average roughness Rz. Rz is the sum of the average of the absolute values of the heights (Yp1 to Yp5) from the highest peak to the fifth highest peak in the reference length L and the average of the absolute values of the depths (Yv1 to Yv5) from the deepest valley to the fifth deepest valley in the reference length L. In the maximum peak-to-valley roughness height Ry, when a local flaw or a recess is present in the measurement range, the measurement value of the flaw or the recess may be extracted as Ry, so that the result may be far from the true surface roughness. However, Rz is the average of a plurality of peaks and valleys, so that a result that is not far from the true surface roughness can be obtained. When Rz is less than 0.7 μm, interference fringes are generated. When Rz exceeds 1.3 μm, white spots in a black portion or black spots in a while portion may be generated during image formation. Therefore, Rz was set to 0.7 to 1.3 μm.

(d) Average peak-to-peak distance Sm=5 to 30 μm: The average peak-to-peak distance Sm is the average of the section length (Smi) given by the sum of the distance of a peak and the distance of a valley adjacent to the peak in the direction in which the average line m is extended, and when the number of the sections in the reference length L is n, Sm is given by Equation (6).

$$Sm = \frac{1}{n}\sum_{i=1}^{n} Smi \tag{6}$$

Sm has a correlation with the adherence between the conductive substrate 11 and the photosensitive layer 15 and the sensitivity to occurrence of interference fringes. When Sm is less than 5 μm or is more than 30 μm, interference fringes are easily generated. Therefore, Sm was set to 5 to 30 μm.

Figure 4:
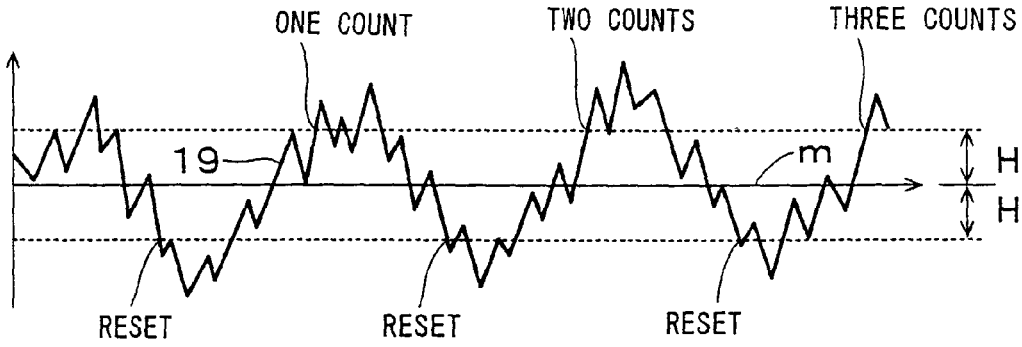
FIG. 4 is a diagram for illustrating the definition of the peak count Pc.

(e) Peak count Pc=60 to 100: FIG. 4 is a diagram for illustrating the definition of the peak count Pc. The peak count Pc is an index of the surface roughness according to the parameter PPI defined by SAE J911-1986 of the Society of Automotive Engineers' Standard. For Pc, predetermined reference levels H on the peak side and the valley side from the average line m of the roughness curve 19 are set, and when the roughness curve 19 exceeds the reference level H set on the peak side after the roughness curve 19 once exceeds the reference level H set on the valley side, this constitutes one count. Pc is the accumulated value of the counts in the reference length L. In this embodiment, Pc was counted, taking 0.2 μm as the reference level H set on the peak side, −0.2 μm as the reference level H set on the valley side, and 4 mm as the reference length L.

The peak count Pc is an index that is affected by the extent of scattering at the time when light is reflected. The number of peaks having larger irregularities than the centerline average roughness Ra can be limited by making the reference levels H during Pc measurement be larger than, for example, the centerline average roughness Ra so as to limit the range of the Pc.

When the Pc is less than 60 and the number of the peaks having large irregularities is small, interference fringes are generated in image formation. When Pc is more than 100 and the number of the peaks having large irregularities is large, scattering reflection of light is increased. Therefore, although there is no possibility of occurrence of interference fringes in image formation, diffuse reflection is increased so that coherent light cannot be obtained. Consequently, it is impossible to measure the thickness of a layer by the optical interferometry. Therefore, Pc was set to 60 to 100.

The following is a possible reason why there is a preferable range for Pc. In a small area that is irradiated with light to form electrostatic latent images on the photoreceptor 10, for example, in a small light spot area at a pixel density of 1200 dpi or more, an appropriate number of comparatively large irregularities formed on the conductive substrate surface 16 allow light to be diffuse-reflected sufficiently in the small area, so that interference fringes are prevented from occurring during image formation. On the other hand, in optical interferometry, a measurement area having a size of about 2 to 5 mm such as a diameter of light emitting/receiving probe used for measuring the thickness of a layer of the photoreceptor 10, even if an appropriate number of comparatively large irregularities formed on the conductive substrate surface 16 allow light for measuring the thickness of a layer to be diffuse-reflected, multiple reflection may occur in a wide measurement area, so that interference slightly occurs and it seems possible to measure the thickness of a layer by optical interferometry by detecting this interference.

Referring back to FIG. 1, the underlying layer 12 is formed on the conductive substrate surface 16 in order to coat defects on the conductive substrate surface 16, improve the charge injection properties from the conductive substrate 11 to the charge generating layer 13, improve the adhesive properties of the photosensitive layer 15 with respect to the conductive substrate 11, and improve the coating properties of the charge generating layer 13. As the material for the underlying layer 12, polyamide, copolyamide, casein, polyvinyl alcohol, cellulose, or gelatin are preferably used. The underlying layer 12 is formed by dissolving at least one substance selected from the above-listed materials in an organic solvent and coating the conductive substrate 11 with the solution such that the thickness is about 0.1 to 5 μm. An inorganic pigment such as alumina, tin oxide, or titanium oxide can be contained and dispersed in the underlying layer 12 for the purpose of improving the characteristics at low temperatures and low humidity and adjusting the resistivity.

The charge generating layer 13 contains the charge generating material that generates charges by light irradiation as the main component, and further may contain a known binding agent (or binder), plasticizer and sensitizer. For the charge generating material, perylene-based pigments, polycyclic quinone-based pigments, metal-free phthalocyanine pigments, metallophthalocyanine pigments, and azo pigments having squarylium, azulenium or thiapyrylium dye and a carbazole backbone, a styryl stilbene backbone, a triphenyl amine backbone, a dibenzothiophene backbone, an oxadiazole backbone, a fluorenone backbone, a bis-stilbene backbone, a distyryl oxadiazole backbone, or a distyryl carbazole backbone are suitably used. Among these pigments, metal-free phthalocyanine pigments, metallophthalocyanine pigments, and azo pigments are particularly preferably used for the charge generating material of the photoreceptor for digital copiers and printers.

The charge conveying layer 14 receives charges generated in the charge generating layer 13, and contains a charge conveying material for conveying the charges, such as a silicone-based leveling agent, and a binding agent (or a binder) as the main components and may further contain a known plasticizer, sensitizer or the like.

For the charge conveying material, electron donative substances such as poly-N-vinylcarbazole and derivatives thereof, poly-γ-carbozoyl ethyl glutamate and derivatives thereof, pyrene-formaldehyde condensates and derivatives thereof, polyvinylpyrene, polyvinylphenanthrene, oxazole derivatives, oxodiazole derivatives, imidazole derivatives, 9-(p-diethylaminostyryl)anthracene, 1,1-bis(4-dibenzylaminophenyl) propane, styryl anthracene, styryl pyrazoline, phenylhydrazones and hydrazone derivatives, or electron accepting substances such as fluorenone derivatives, dibenzothiophene derivatives, indenothiophene derivatives, phenanthrenequinone derivatives, indenopyridine derivatives, thioxanthone derivatives, benzo[c]cinnoline derivatives, phenazine oxide derivatives, tetracyanoethylene, tetracyanoquinodimethane, promanyl, chloranil and benzoquinone can be used preferably.

For the binding agent (or the binder) contained in the charge conveying layer 14, substances having a compatibility with the charge conveying material, for example, polycarbonate, polyvinylbutyral, polyamide, polyester, polyketone, epoxy resin, polyurethane, polyvinylketone, polystyrene, polyacrylamide, phenolic resin, phenoxy resin or the like can be used.

Figure 5:
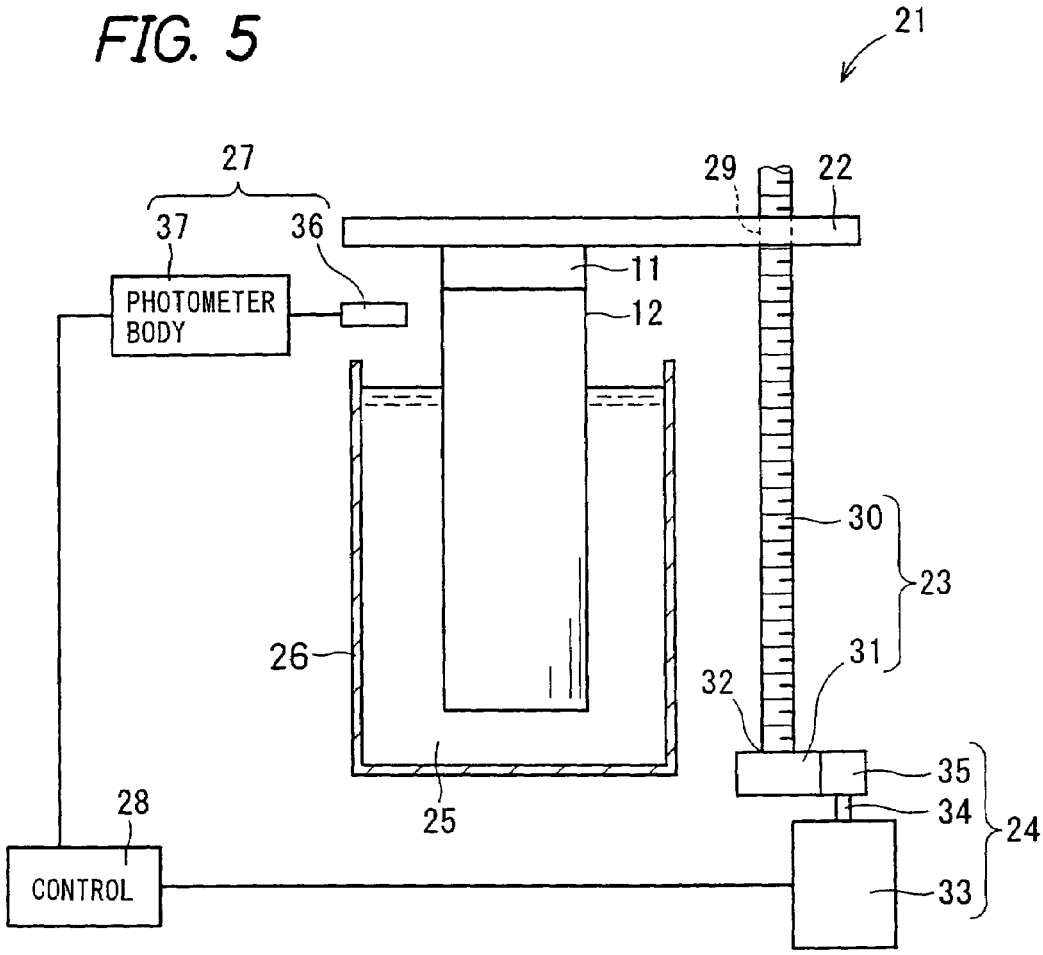
FIG. 5 is a diagram showing a simplified structure of a coating apparatus used for production of a photoreceptor.

FIG. 5 is a diagram showing a simplified structure of a coating apparatus 21 used for production of the photoreceptor 10. The coating apparatus 21 includes an arm 22 for suspending the conductive substrate 11 in such a manner that the direction in which the axis of the conductive substrate 11 is extended is set to the vertical direction, elevating and lowering means 23 for elevating and lowering the arm 22 in the vertical direction, driving means 24 for driving the elevating and lowering means 23, a container 26 containing a coating solution 25, a spectrophotometer 27 for measuring the thickness of a layer to be formed on the conductive substrate 11 such as the underlying layer 12 by optical interferometry, and controlling means 28 for outputting a driving control signal to the driving means 24 in response to the measurement results of the thickness of the layer by the spectrophotometer 27.

The container 26 is made of, for example, stainless steel or the like and is a hollow container having a shape of a rectangular solid provided with an opening on one side thereof. For the coating solution 25, not only a solution for forming the underlying layer 12 that is shown, but also solutions for forming the charge generating layer 13 and the charge conveying layer 14 are prepared individually in separate containers.

For the coating solution for forming the underlying layer 12, a solution in which for example, titanium oxide and copolyamide resin are dispersed in a mixed solvent of ethanol, methanol, methanol/dichloroethane or the like is used. For the coating solution for forming the charge generating layer 13, a solution in which a charge generating material such as an azo-based pigment together with a binding agent, a plasticizer, a sensitizer or the like is dispersed in a solvent such as cyclohexanone, benzene, chloroform, dichloroethane, ethyl ether, acetone, ethanol, chlorobenzene, or methylethylketone is used. For the coating solution for forming the charge conveying layer 14, a solution in which a charge conveying material such as a hydrazone-based compound, a silicone-based leveling agent and a binding agent (or a binder) together with a plasticizer, a sensitizer or the like is dispersed in a solvent such as dichloroethane, benzene, chloroform, cyclohexanone, ethyl ether, acetone, ethanol, chlorobenzene, or methylethylketone is used.

The arm 22 is made of metal or hard synthetic resin, and the conductive substrate 11 is suspended in the vicinity of one end thereof in the manner as described above, and a female screw portion 29 in which a female screw is provided is formed in the vicinity of the other end. The elevating and lowering means 23 include a slide screw 30 and a first gear 31 provided securely in one end portion 32 of the slide screw 30. The slide screw 30 is engaged in the female screw portion 29 formed in the arm 22.

The driving means 24 includes, for example, an electric motor 33 and a second gear 35 provided securely in an output shaft 34 of the electric motor 33. The second gear 35 of the driving means 24 is engaged with the first gear 31 of the elevating and lowering means 23. Therefore, the rotational driving force around the axis of the output shaft 34 of the electric motor 33 is transmitted to the slide screw 30 via the second gear 35 and the first gear 31. Then, the rotation around the axis of the slide screw 30 moves the arm 22 engaged with the slide screw 30 in the female screw portion 29 and the conductive substrate 11 suspended by the arm 22 in the vertical direction.

Figure 6:
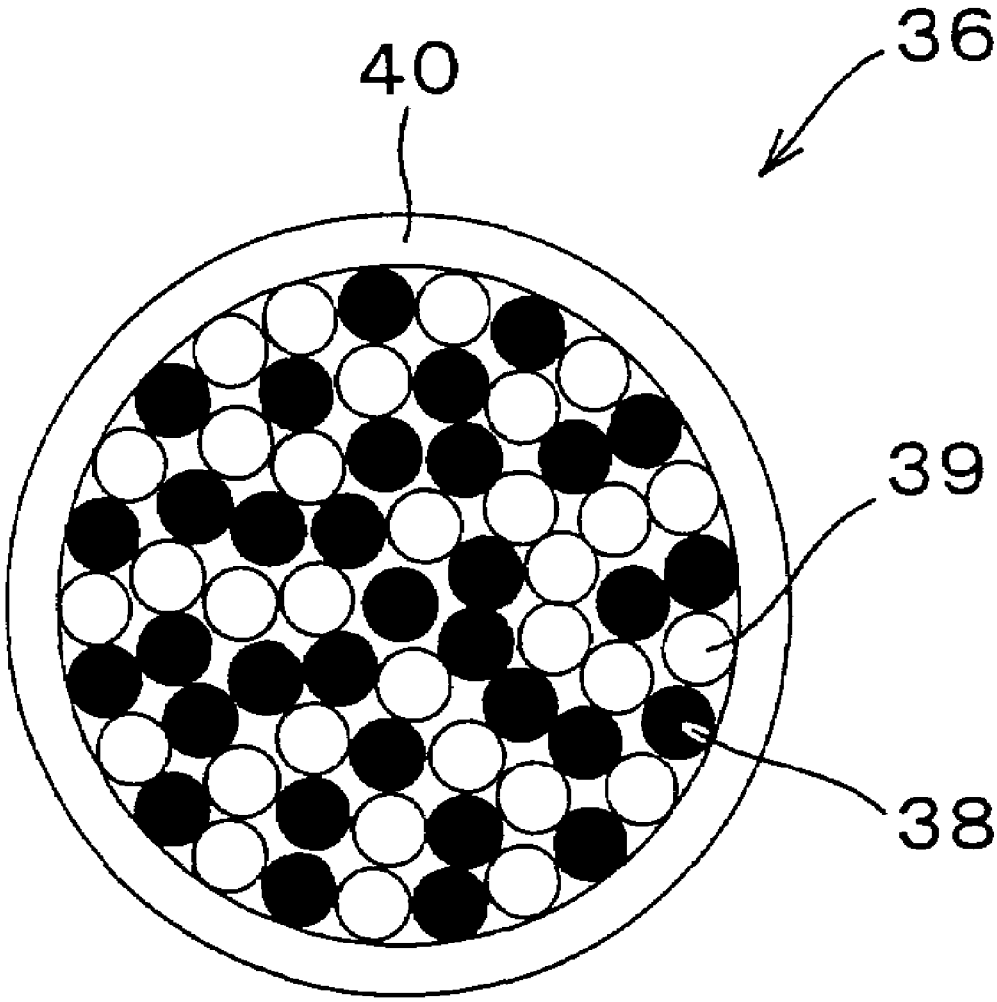
FIG. 6 is a front view of a simplified structure of a probe that is viewed from the side from which light is emitted.

The spectrophotometer 27 is, for example, MCPD-1100 (manufactured by Otsuka Electronics Co., Ltd.), and includes a light emitting/receiving probe 36 (hereinafter, abbreviated as a probe) and a photometer body 37. FIG. 6 is a front view of a simplified structure of the probe 36 that is viewed from the side from which light is emitted. In the probe 36, a plurality of light-emitting fibers 38 and a plurality of light-receiving fibers 39 are bundled and housed in a casing 40. Therefore, the probe 36 emits light for measurement of the thickness of a layer and receives a coherent light that is multiple-reflected in the underlying layer 12 and the conductive substrate 11. The photometer body 37 is provided with a calculating portion for calculating the thickness of the underlying layer 12 based on Equation (4) with the coherent light received by the probe 36.

The controlling means 28 is a processing circuit that can be implemented by a microcomputer in which a central processing unit (CPU) is mounted. The controlling means 28 includes, for example, Read Only Memory (ROM), and a controlling program for operating the controlling means 28 is previously stored in the ROM. According to the controlling program that is read from the ROM, the controlling means 28 outputs a controlling signal for controlling the rotational speed of the driving means 24 in response to the thickness of a layer that is the measurement result output from the spectrophotometer 27.

In the coating apparatus 21, when forming the underlying layer 12 on the conductive substrate 11, the thickness of the underlying layer 12 is measured sequentially with the spectrophotometer 27 employing the optical interferometry, and the thickness of the layer that is the measurement result is fed back to the controlling means 28, and further the controlling means 28 controls the lifting speed of the conductive substrate 11 from the coating solution 25 via the driving means 24 and the elevating and lowering means 23 so as to adjust the thickness of the underlying layer 12. The conductive substrate 11 that is lifted while the thickness is adjusted is dried, and thus the underlying layer 12 is formed. When forming the charging generating layer 13, which is an outer layer of the underlying layer 12, and further the charge conveying layer 14, which is an outer layer of the charge generating layer 13, the thickness can be adjusted in the same manner as in the case of forming the underlying layer 12.

In the conductive substrate 11 constituting the photoreceptor 10 produced in the above-described manner, its surface roughness is in a preferable range, and the thickness of the layer by the optical interferometry can be performed with high precision, so that when coating and forming the layers 12, 13, and 14 constituting the photosensitive layer 15, it is possible to form the thickness of the layer stably and prevent non-uniformity in the thickness of the layer. Furthermore, it is possible to produce the photoreceptor 10 in which interference fringes do not occur.

Figure 7:
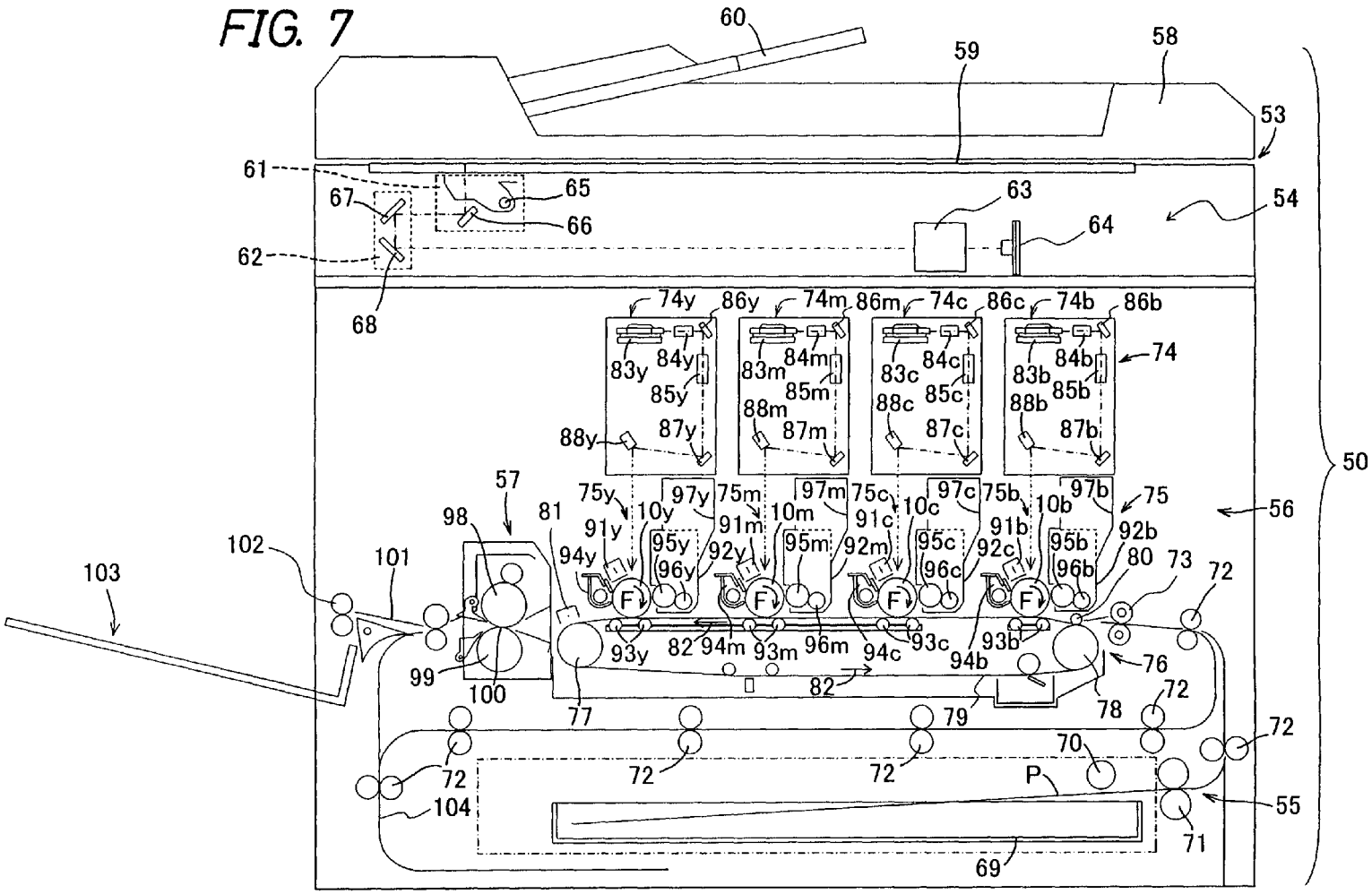
FIG. 7 is a schematic cross-sectional view showing a simplified structure of an image forming apparatus, which is another embodiment of the invention.

FIG. 7 is a schematic cross-sectional view showing a simplified structure of an image forming apparatus 50, which is another embodiment of the invention. The image forming apparatus 50 shown in FIG. 7 is another embodiment of the invention, and herein, a copier 50, which is an image forming apparatus, will be described as an example. Referring to FIG. 7, the structure and the operation of the copier 50 provided with the photoreceptor 10 of this embodiment will be described.

The copier 50 includes a document feeding portion 53, an image reading portion 54, a paper feeding portion 55, an image forming portion 56, and a fixing portion 57. The document feeding portion 53 includes a reversing automatic document feeder (abbreviated as RADF) 58 for feeding a document sheet to be copied, a document table 59 on a predetermined position of which the document sheet fed from the RADF 58 is mounted, and a document-receive tray 60. The RADF 58 has a predetermined positional relationship with respect to the document table 59 and is supported in such a manner that RADF 58 can be opened and closed. The RADF 58 feeds the document sheet in such a manner that one face of the document sheet is mounted on a predetermined position of the document table 59 that is opposed to the image reading portion 54. When image reading of one face is finished, the document sheet is fed reversely in such a manner that the other face of the document sheet is mounted on a predetermined position of the document table 59 that is opposed to the image reading portion 54. When image reading of the other face is finished, the document sheet is discharged to the document-receive tray 60. The feeding of the document sheet and the face and back reversing operation are controlled in conjunction with the whole operation of the copier 50. When copying only one face of the document sheet, the reverse feeding is not performed.

The image reading portion 54 is positioned below the document table 59, performs an operation of reading an image of the document sheet fed onto the document table 59 by the RADF 58, and includes a first and a second scanning unit 61 and 62 that reciprocate in parallel with and along the lower surface of the document table 59, an optical lens 63, a CCD (charge coupled device) line sensor 64, which is a photoelectric transducer.

The first scanning unit 61 includes an exposure lamp 65 for exposing the image surface of the document sheet to be read to light and a first mirror 66 that deflects a reflected light image from the document sheet to a predetermined direction, and reciprocates at a predetermined scanning rate while maintaining a constant distance with respect to the lower surface of the document table 59. The second scanning unit 62 includes second and third mirrors 67 and 68 that deflect the reflected light image that has been deflected by the first mirror 66 of the first scanning unit 61 to a predetermined direction, and reciprocates in parallel with and along the lower surface of the document table 59 while maintaining a certain rate relationship with the first scanning unit 61.

The optical lens 63 scales down the reflected light image that has been deflected by the third mirror 68 of the second scanning unit 62, and forms an image on a predetermined position of the CCD line sensor 64. The CCD line sensor 64 is a three line color CCD that can read a black-and-white image or a color image and output line data which are the results of color separation into each color component of red (R), green (G) and blue (B), and photoelectrically converts the reflected light image formed by the optical lens 63 sequentially so as to output electric signals. The document image information output as the electric signals from the CCD line sensor 64 is input to the image forming portion 56.

The paper feeding portion 55 is positioned in the lowest portion of the copier 50 and includes a paper tray 69 for housing a recording sheet P that is a recording medium, a separating roller 70 and a paper feeding roller 71 for feeding the recording sheet P in the paper tray 69 separately one by one, and supplies the recording sheet P that is a recording medium to the image forming portion 56. The recording sheet P that is supplied separately one by one from the paper feeding portion 55 is conveyed immediately before the image forming portion 56 by conveying rollers 72 provided in several portions on the path for conveying the recording sheet P, and supplies the recording sheet P to the image forming portion 56 at a paper feeding timing that is controlled by a pair of resist rollers 73 provided immediately before the image forming portion 56.

The image forming portion 56 is positioned between the image reading portion 54 and the paper feeding portion 55 and includes a laser beam scanner unit 74, an image forming station 75, and a transfer conveying belt mechanism 76. The transfer conveying belt mechanism 76 is positioned below the image forming portion 56 and includes a driving roller 77, a driven roller 78, an endless belt 79 stretched between the driving roller 77 and the driven roller 78, a charger 80 for absorption for charging the surface of the endless belt 79 to absorb the recording sheet P, and a discharger 81 for detaching the recording paper P adsorbed onto the endless belt 79.

The endless belt 79 is driven by the rotation around the axis of the driving roller 77 in the direction shown by an arrow 82. The recording paper P supplied at a timing controlled by the resist roller 73 is adsorbed electrostatically onto the endless belt 79 whose surface is charged by the charger 80 for adsorption, and conveyed in the direction shown by the arrow 82. In the course of being conveyed in the direction shown by the arrow 82 by the endless belt 79, the image is transferred onto the recording sheet P, and the recording sheet P on which the image is transferred is detached from the endless belt 79 by the discharger 81 and conveyed to the fixing portion 57. For the timing control of feeding of the paper by the resist roller 73, the edge portion of the recording sheet P in the conveying direction is detected by a sensor (not shown) provided in the conveying path, and the paper is fed in response to the detection output of the sensor.

The copier 50 is a color copier, so that four sets of the laser beam scanner unit 74 and the image forming station 75 are provided corresponding to black, cyan, magenta and yellow. The laser beam scanner units 74 and the image forming stations 75 have the same structure as each other except that the colors of toners used for development are different such as black, cyan, magenta, and yellow, and that pixel signals corresponding to black component images, pixel signals corresponding to cyan component images, pixel signals corresponding magenta component images, pixel signals corresponding to yellow component images of the image document information are input, respectively. Therefore, the laser beam scanner unit 74 for black and the image forming station 75 for black will be described as typical examples, and others will be not be described. When the laser beam scanner unit 74 and the image forming station 75 corresponding to each color are desired to be indicated individually, subscripts: b for black, c for cyan, m for magenta, and y for yellow are used.

Figure 8:
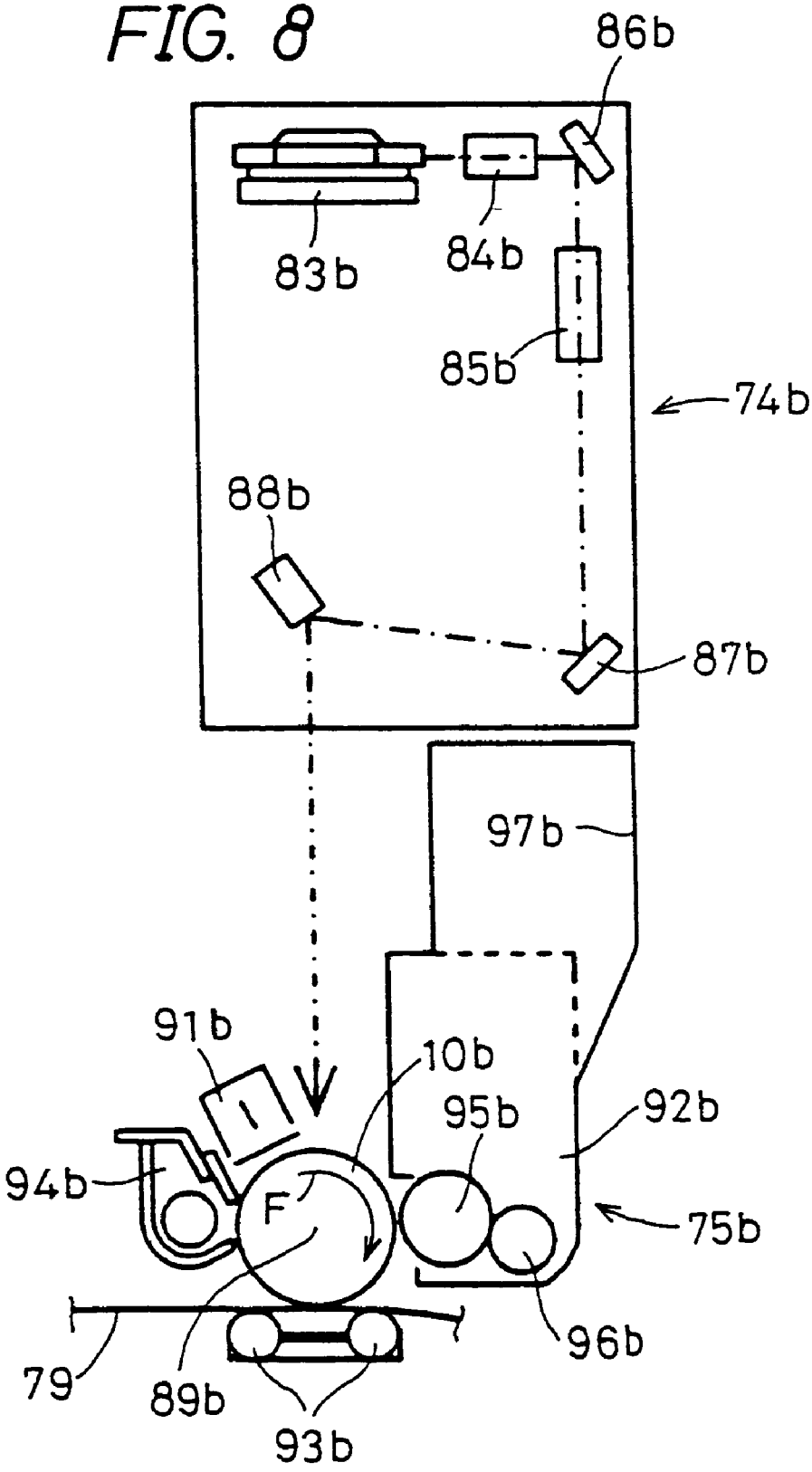
FIG. 8 is an enlarged view showing the structures of a laser beam scanner unit and an image forming station for black image formation.

FIG. 8 is an enlarged view showing the structures of the laser beam scanner unit **74*b* for black image formation and the image forming station 75*b*. The laser beam scanner unit 74*b* includes a semiconductor laser element (not shown) that emits a dot light modulated in accordance with the image document information input from the image reading portion 54, a polygon mirror 83*b* that deflects a laser beam from the semiconductor laser element to the main scanning direction, fθ lenses 84*b* and 85*b* and reflecting mirrors 86*b*, 87*b*, and 88*b* that focus the laser beam deflected by the polygon mirror 83*b* on the surface of the photoreceptor 10*b* so as to form an image. The surface of the photoreceptor 10*b* of the image forming station 75*b* is exposed to the laser beam reflected by the reflecting mirror 88*b*, and thus an electrostatic latent image is formed. The laser beam scanner unit 74*b* constitutes an exposure apparatus that irradiates the surface of the photoreceptor 10*b*** with light for exposure.

The laser beam scanner unit **74*b*, which is an exposure apparatus, performs image-exposure at a pixel density of 1200 dpi or more so that an electrostatic latent image is formed on the surface of the photoreceptor 10***b*. That is to say, the copier 50 of this embodiment having the laser beam scanner units 74 is equipment for high resolution.

The image forming station 75*b* includes the photoreceptor 10*b* that is supported rotatably around the axis 89*b* in the direction shown by an arrow F and the following equipment positioned along the circumferential surface of the photoreceptor 10*b*: a charger 91*b* that charges uniformly the surface of the photoreceptor 10*b* before being exposed to the laser beam as described above; a developing device 92*b* that develops the latent image formed on the surface of the photoreceptor 10*b* by the exposure to the laser beam output from the laser beam scanner unit 74*b* so as to form visible images; a discharger 93*b* for transfer that is opposed to the photoreceptor 10*b* via the endless belt 79 and transfers the developed image on the recording sheet P on the endless belt 79; and a cleaning unit 94*b* that removes and collects toner remaining on the surface of the photoreceptor 10*b* after the development treatment of the latent image. The charger 91*b*, the developing device 92*b*, the discharger 93*b* for transfer and the cleaning unit 94*b* are provided in this order from the upstream to the downstream in the rotation direction shown by the arrow F.

The charger 91*b* charges uniformly the surface of the photoreceptor 10*b* by discharge. The surface of the uniformly charged surface of the photoreceptor 10*b* is exposed to light by the laser beam from the laser beam scanner unit 74*b* in accordance with the image document information, and a difference in the charge amount between the exposed portion and the non-exposed portion so that the electrostatic latent images are formed.

The developing device 92*b* includes a developing roller 95*b* opposed to the photoreceptor 10*b*, a developer conveying roller 96*b* that supplies a developer containing toner to the developing roller 95*b*, and a casing 97*b* that supports rotatably the developing roller 95*b* and the developer conveying roller 96*b* and houses the developer in its internal space. The developer is supplied from the developing roller 95*b* of the developing device 92*b* to the surface of the photoreceptor 10*b* on which electrostatic latent images are formed, so that the electrostatic latent images are developed and converted to visible images. The visible images are transferred onto the recording sheet P on the endless belt 79 by the discharger 93*b* for transfer as described above.

Referring back to FIG. 7, cyan, magenta, and yellow images are sequentially transferred on the recording sheet P on which the black images are transferred in the same manner as in the case of the black images as described above, while the recording paper P adsorbed onto the endless belt 79 is conveyed in the direction shown by the arrow 82 and is passing through cyan, magenta, and yellow laser beam scanner units 74*c*, 74*m* and 74*y* and image forming stations 75*c*, 75*m* and 75*y* that are provided in this order from the upstream to the downstream in the conveying direction. Thus, full color images are formed on the recording sheet P. The recording sheet P on which the full color images are formed is detached from the endless belt 79 from the discharger 81 and supplied to the fixing portion 57.

The fixing portion 57 includes a heating roller 98 provided with heating means (not shown), and a pressure roller 99 opposed to the heating roller 98 and pressed by the heating roller 98 so as to form a contact portion, that is, a so-called nip portion 100. The recording sheet P supplied to the fixing portion 57 is heated and pressed while passing through the nip portion 100, so that the developer on the recording sheet P is fixed to form solid images.

The recording sheet P fixed by the fixing portion 57 is fed upward by a switching gate 101 when forming images on only one surface or forming images on a second surface after images are formed on a first surface and the sheet is reversed. Further, the recording sheet P is discharged to the paper-out tray 103 by a paper-out roller 102. In the case where images are formed on one surface and then subsequently on the other surface, the recording sheet P is fed downward by the switching gate 101, and passes through a switchback conveying path 104 and is reversed. Then, the recording sheet P is conveyed again to the image forming portion 56. Images are formed on the recording sheet P supplied to the image forming portion 56 in the same manner as above.

As described above, the copier 50 of this embodiment includes the photoreceptor 10 having the conductive substrate 11 whose surface roughness is limited to the preferable range with Ry, Ra, Rz, Sm and Pc as the indices of the roughness, and the laser beam scanner units 74 that can irradiate light for image-exposure on the surface of the photoreceptor 10 at a pixel density of 1200 dpi or more. Thus, image-exposure is performed on the photoreceptor 10 having the conductive substrate 11 at a pixel density of 1200 dpi or more so as to form electrostatic latent images. Therefore, a copier in which interference fringes can be prevented and high resolution and high quality images can be formed can be realized.

EXAMPLES

Hereinafter, examples of the invention will be described. However, the invention is not limited to the examples.

Examples 1 to 11

A cylindrical conductive substrate made of aluminum having a diameter of 30 mm, a thickness of 0.75 mm and a length of 322.3 mm was prepared. The outer circumferential surface of this cylindrical conductive substrate made of aluminum is cut and processed with a diamond cutting tool while varying the shape of the blade of the cutting tool, the travel speed of the cutting tool, the type of a lubricant and the like. In this manner, the surface was finished such that the surface roughness was in the range of the invention: (a) the maximum peak-to-valley roughness height Ry: 0.8 to 1.4 μm, (b) the centerline average roughness Ra: 0.10 to 0.15 μm, (c) the ten-point average roughness Rz: 0.7 to 1.3 μm, (d) the average peak-to-peak distance Sm: 5 to 30 μm, and (e) the peak count Pc: 60 to 100. The surface roughness of the cut and processed conductive substrate, that is, (a) to (e) were measured with a surface roughness meter SURFCOM 570A (manufactured by Tokyo Seimitsu Co. Ltd.).

First, an underlying layer was formed on the conductive substrate whose surface was finished in the above-described manner. As the coating solution for the underlying layer, a solution in which 6 parts by weight of a copolyamide resin (CM 4000 manufactured by Toray Industries Inc.) was dissolved in 94 parts by weight of methanol was used. This coating solution was applied onto the conductive substrate with the coating apparatus 21 while the thickness of the layer was adjusted and thus, an underlying layer having a thickness of about 0.9 μm was formed. The spectrophotometer by optical interferometry used to measure the thickness of the layer in the coating apparatus 21 was MCPD-1100 manufactured by Otsuka Electronics Co., Ltd. The MCPD-1100 has an optical probe having a diameter of 10 mm, and this probe was disposed in a position on the extended direction of the radial direction of the conductive substrate that is about 2 mm apart from the outer circumferential surface of the conductive substrate. Thus, the irradiation diameter of light in the outer circumferential surface of the conductive substrate was about 3 mm. The wavelength of the light used for measurement of the thickness of the layer was 550 to 850 nm, and the reflection spectrum of the coated underlying film was measured. Prior to the measurement, an underlying layer whose thickness is known was formed with the same composition and the refractive index of this underlying layer was obtained based on Equation (4) from its interference pattern, and is input to the calculating portion of the spectrometer body. This previously obtained refractive index and the reflection spectrum of the measured coated underlying film were used to obtain the thickness of the layer based on Equation (4).

Next, a charge generating layer was formed as the outer layer of the underlying layer. As the coating solution for the charge generating layer, a solution prepared by mixing one part of X-metal-free phthalocyanine, one part by weight of butyral resin (S-LEC BM-2 manufactured by Sekisui Chemical Co., Ltd.) and 120 parts by weight of tetrahydrofuran and dispersing the mixture for 12 hours with a ball mill was used. This coating solution was applied onto the outer layer of the underlying layer with the coating apparatus 21 while the thickness of the layer was adjusted, and thus a charge generating layer having a thickness of about 0.2 μm was formed. The thickness of the layer was measured in the same manner as when the thickness of the underlying layer was measured as described above.

Next, a charge conveying layer was formed as the outer layer of the charge generating layer. As the coating solution for the charge conveying layer, a solution prepared by adding one part of hydrazone-based charge conveying material (ABPH manufactured by NIPPON KAYAKU CO., LTD), one part by weight of polycarbonate resin (PANLITE L-1250 manufactured by TEIJIN CHEMICALS LTD.) and 0.00013 parts by weight of a silicone-based leveling agent (KF-96 manufactured by Shin-Etsu Chemical Co., Ltd.) to 8 parts by weight of dichloroethane and heating the mixture at 45° C. to dissolve and then cooling naturally after the mixture was dissolved was used. This coating solution was applied onto the outer layer of the charge generating layer with the coating apparatus 21 while the thickness of the layer was adjusted, and thus a charge conveying layer having a thickness of about 22 μm was formed. The wavelength of the light used for measurement of the thickness of the layer was 650 to 750 nm, and the reflection spectrum of the combined coated film of the charge generating layer and the charge conveying layer was measured, and the thickness of the combined layer of the charge generating layer and the charge conveying layer was obtained based on Equation (4). Then, the thickness of the charge generating layer was subtracted therefrom to obtain the thickness of the charge conveying layer. In this manner, photoreceptors of Examples 1 to 11 provided with the conductive substrate whose the indices of the surface roughness were in the range of the invention were produced.

Comparative Examples 1 to 11

The photoreceptors of Comparative Examples 1 to 11 were produced by cutting and processing the outer circumferential surface of the conductive substrate while varying the conditions such as the shape of the blade of the cutting tool, the travel speed of the cutting tool, the type of a lubricant and the like in the same manner as in Examples 1 to 11 except that the surface was finished such that at least one of the index values of the surface roughness of Ry, Ra, Rz, Sm and Pc is outside the range of the invention.

The photoreceptors of Examples 1 to 11 and Comparative Examples 1 to 11 produced in the above-described manner were mounted in a copier and the quality of images formed by the copier was evaluated. The degree of difficulty of the layer thickness measurement of the underlying layer (hereinafter, referred to as "UC film thickness measurement") and the degree of difficulty of the measurement of the total thickness of the charge generating layer and the charge conveying layer (hereinafter, referred to as "CT film thickness measurement") in the process of the photoreceptor production were evaluated. Hereinafter, the evaluation criteria will be described.

Quality: photoreceptors of Examples 1 to 11 and Comparative Examples 1 to 10 were mounted in a copier provided with a laser beam scanner unit that emits a laser light having a wavelength of 780 nm for image-exposure at a pixel density of 1200 dpi on the surface of the photoreceptors sensitive to this laser light, so that images were formed on a recording sheet. Only the photoreceptor of Comparative Example 11 was mounted in a copier provided with a laser beam scanner unit that emits a laser light having a wavelength of 780 nm for image-exposure at a pixel density of 600 dpi on the surface of the photoreceptors sensitive to this laser light, so that images were formed on a recording sheet. That is to say, in Comparative Example 11, the quality of the images formed by a low resolution copier using a photoreceptor including a conductive substrate whose indices of the surface roughness were outside the invention was evaluated.

The images formed by the copier in which each photoreceptor was mounted were observed visually and evaluated in the following criteria: when no image defects were observed, the photoreceptor was evaluated as "very good" (VG); when interference fringes and/or black spots were slightly observed but caused no practical problems, the photoreceptor was evaluated as "good" (G); when many interference fringes and/or black spots were observed so that the photoreceptor cannot withstand practical use, the photoreceptor was evaluated as "poor" (P).

Figure 9:
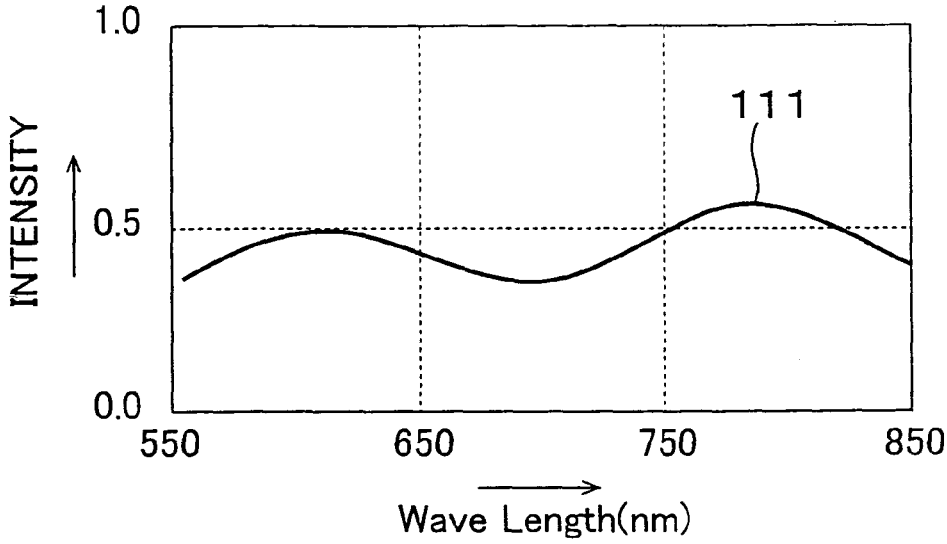
FIG. 9 is a graph showing a reflection spectrum during measurement of the thickness of an underlying layer.
Figure 10:
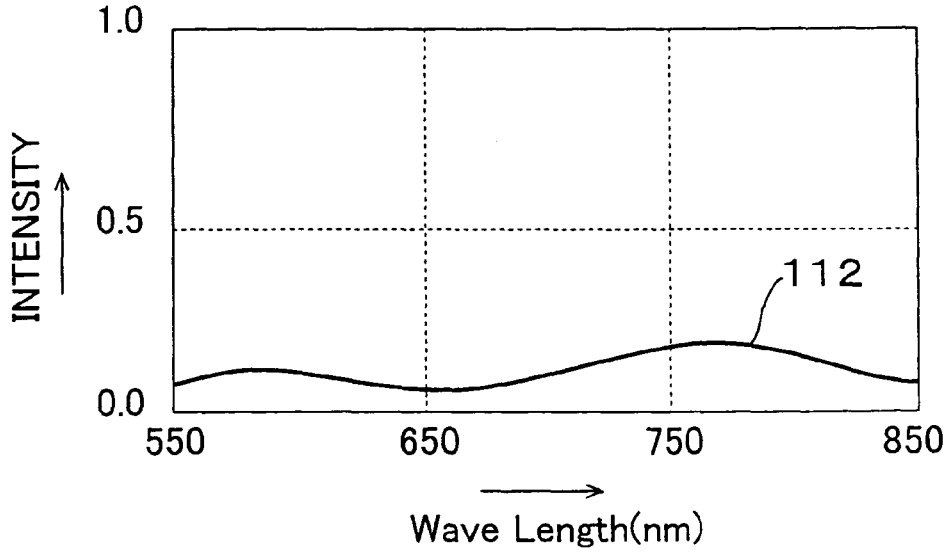
FIG. 10 is a graph showing a reflection spectrum during measurement of the thickness of an underlying layer.
Figure 11:
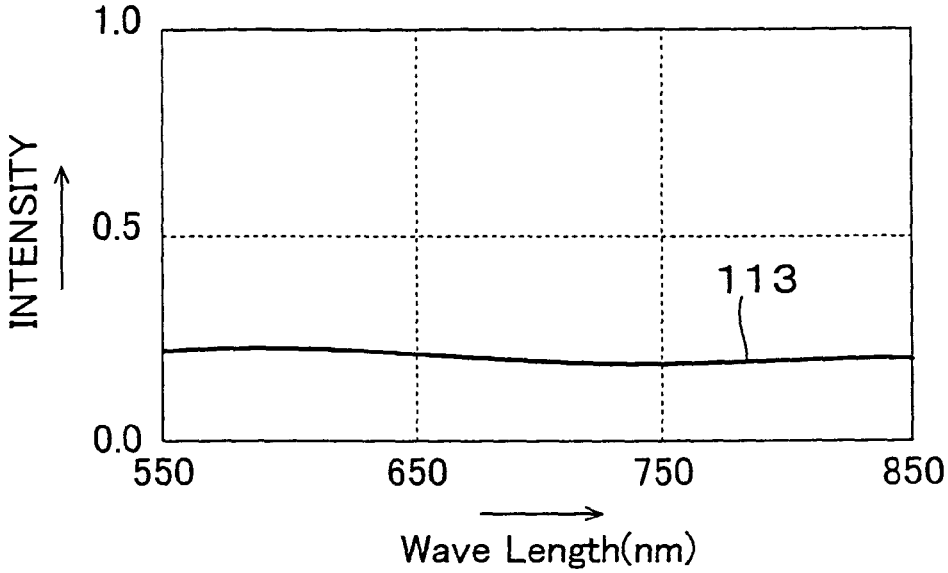
FIG. 11 is a graph showing a reflection spectrum during measurement of the thickness of an underlying layer.

UC film thickness measurement: The degree of the difficulty of the measurement was evaluated with the interference pattern of the reflection spectrum measured during measurement of the thickness of the underlying layer in the process of forming the underlying layer. FIGS. 9 to 11 are graphs showing the reflection spectra during measurement of the thickness of the underlying layer. The lines 111, 112, and 113 shown in FIGS. 9 to 11, respectively are the reflection spectra during measurement of the thickness of the underlying layer. When there were at least two interference peaks in the measurement wavelength range as in the line 111 in FIG. 9 and the thickness could be measured easily, the photoreceptor was evaluated as "good" (G). When it was possible to measure the thickness although it was slightly difficult to observe interference peaks in the measurement wavelength range as in the line 112 in FIG. 10, the photoreceptor was evaluated as "fair" (F). When there was no interference peak in the measurement wavelength range as in the line 113 in FIG. 11 and the thickness could not be measured, the photoreceptor was evaluated as "poor" (P).

Figure 12:
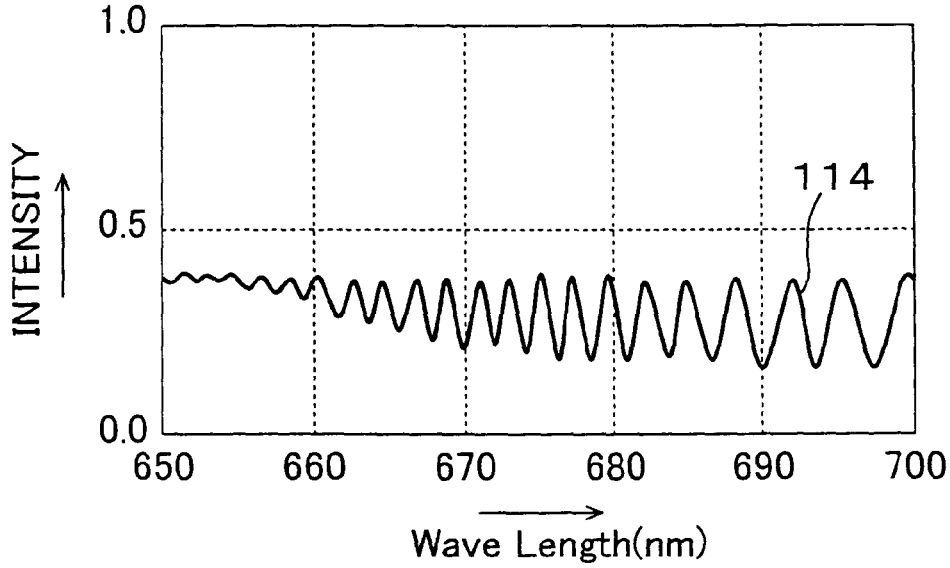
FIG. 12 is a graph showing a reflection spectrum during measurement of the combined thickness of a charge generating layer and a charge conveying layer.
Figure 13:
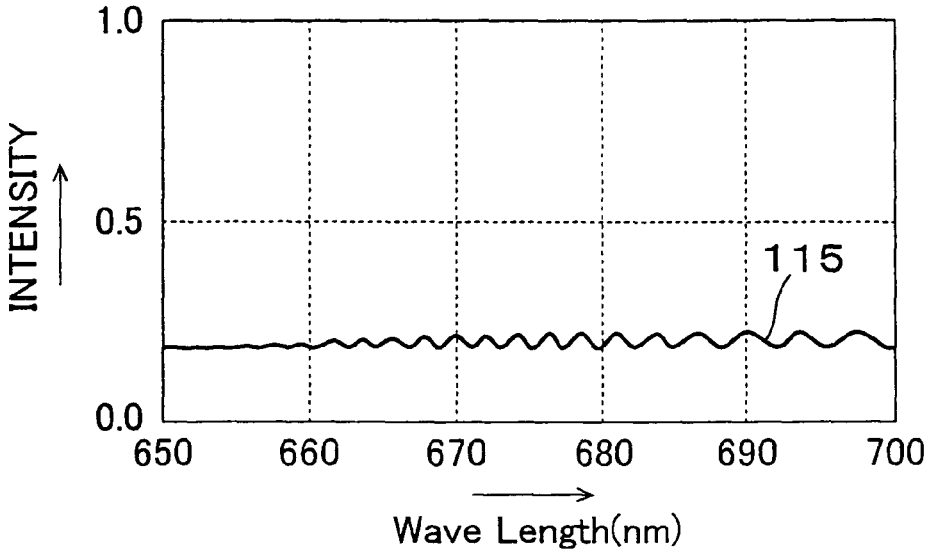
FIG. 13 is a graph showing a reflection spectrum during measurement of the combined thickness of a charge generating layer and a charge conveying layer.
Figure 14:
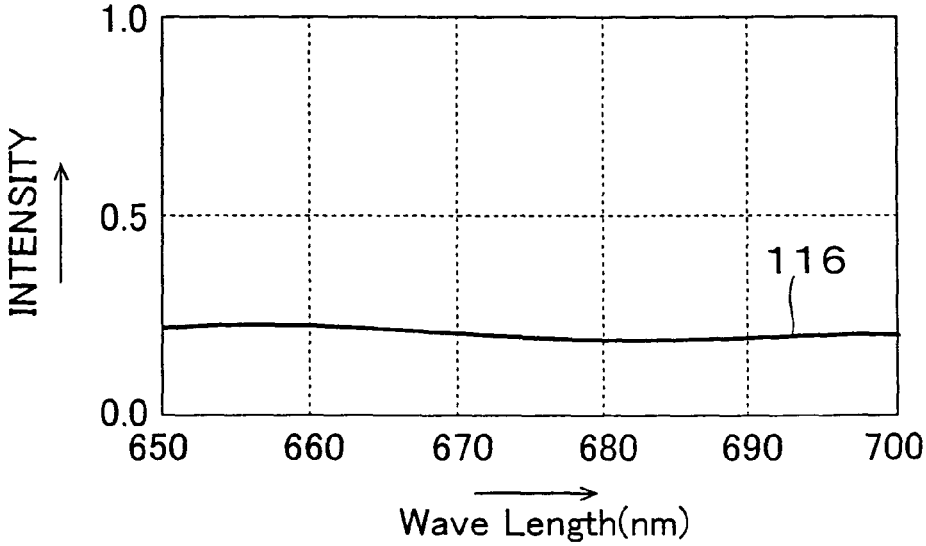
FIG. 14 is a graph showing a reflection spectrum during measurement of the combined thickness of a charge generating layer and a charge conveying layer.
Figure 15A:
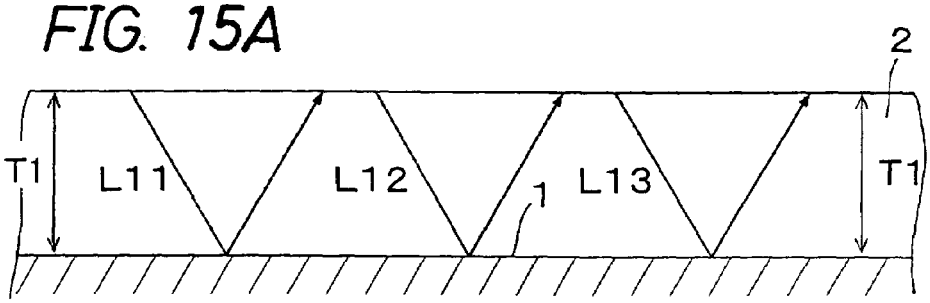
FIGS. 15A and 15B are views showing the manner in which light is reflected in a substrate surface.
Figure 15B:
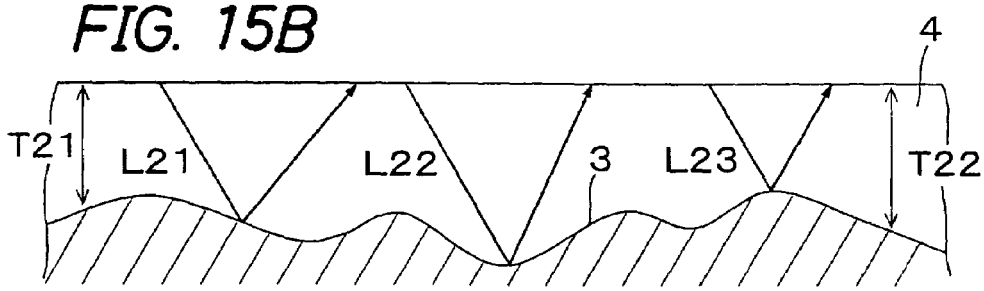
Figure 16A:
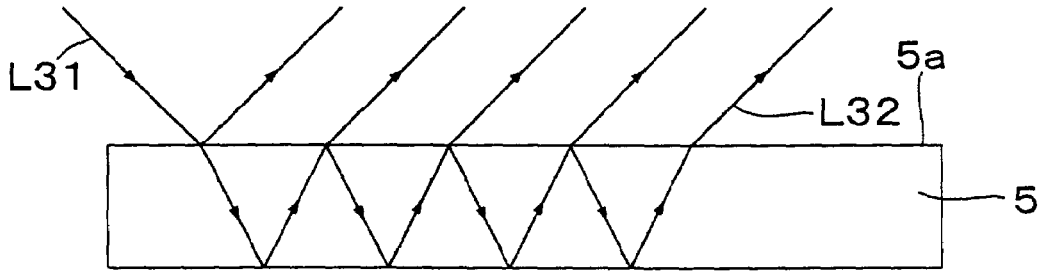
FIGS. 16A and 16B are views showing the reflection behavior of light in a transparent film x.
Figure 16B:
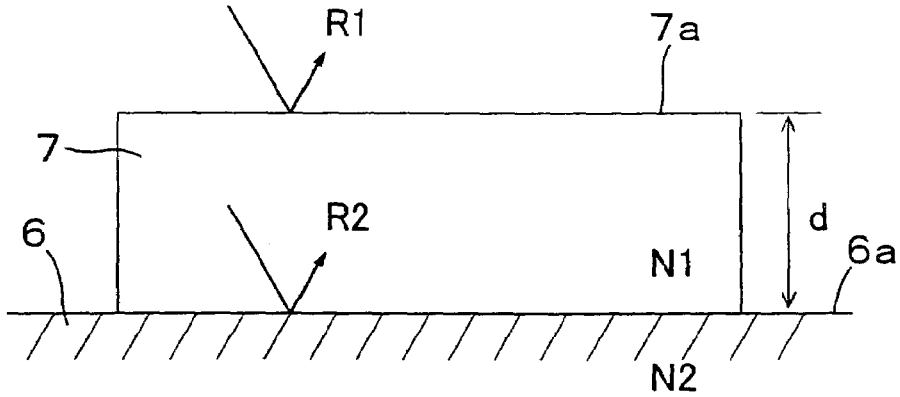

CT film thickness measurement: The degree of the difficulty of the measurement was evaluated with the interference pattern of the reflection spectrum measured during measurement of the combined thickness of the charge generating layer and the charge conveying layer in the process of forming the charge conveying layer. FIGS. 12 to 14 are graphs showing the reflection spectra during measurement of the combined thickness of the charge generating layer and the charge conveying layer. The lines 114, 115, and 116 shown in FIGS. 12 to 14, respectively are the reflection spectra during measurement of the thickness of the layer. When definite interference peaks were observed in the measurement wavelength range as in the line 114 in FIG. 12 and the thickness could be measured easily, the photoreceptor was evaluated as "good" (G). When it was possible to measure the thickness although it was slightly difficult to observe interference peaks in the measurement wavelength range as in the line 115 in FIG. 13, the photoreceptor was evaluated as "fair" (F). When there was no interference peak in the measurement wavelength range as in the line 116 in FIG. 14 and the thickness could not be measured, the photoreceptor was evaluated as "poor" (P).

Table 1 collectively shows the evaluation results of Examples 1 to 11 and Comparative Examples 1 to 11. As shown in Table 1, in Examples 1 to 11, the image quality evaluation results are either "VG" or "G", the evaluation results of the UC film thickness measurement and the CT film thickness measurement are either "G" or "F". In other words, when the photoreceptor including the conductive substrate whose surface was finished such that the indices of the surface roughness were in the preferable range defined by the invention was applied to a high resolution image forming apparatus, high quality images were formed successfully and the thickness of the photosensitive layer was successfully measured with a high precision by the optical interferometry.

In Comparative Examples 1 to 9 in which the photoreceptor including the conductive substrate whose surface was finished such that at least one of the indices of the surface roughness was outside the preferable range defined by the invention was applied to a high resolution image forming apparatus, the image quality was evaluated as "P". In Comparative Example 10, the film thickness measurement was evaluated as "P". In particular, in Comparative Example 9 in which the peak count Pc, which is the most characteristic index of the surface roughness of the invention, was less than the lower limit, the image quality was evaluated as "P" although the UC and CT film thickness measurement was evaluated as "G". In Comparative Example 10 in which the peak count Pc was more than the upper limit, the UC and CT film thickness measurement was evaluated as "P" although the image quality was evaluated as "VG"

In Comparative Example 11 in which the photoreceptor including the conductive substrate whose surface was finished such that all of the indices of the surface roughness were outside the preferable range defined by the invention was applied to a low resolution image forming apparatus with 600 dpi, the image quality was evaluated as "VG", and since the Pc was less than the lower limit, the UC and CT film thickness measurement was evaluated as "G".

The evaluation results of Comparative Examples 1 to 11 indicate that in the low resolution image forming apparatus with 600 dpi, a certain level of quality can be obtained even if the surface of the conductive substrate is not particularly rough, and therefore it is easy to measure the thickness of the layer by the optical interferometry. On the other hand, in the high resolution image forming apparatus with 1200 dpi, it was difficult to achieve both good image quality and film thickness measurement by the optical interferometry without precisely defining the surface roughness. In other words, it was clarified that the effect of both improving the image quality and measuring the film thickness with a high precision by the optical interferometry by precisely defining the surface roughness of the conductive substrate is exhibited remarkably in an image forming apparatus including an exposure apparatus that forms electrostatic latent images by image-exposure at a pixel density of 1200 dpi or more on the surface of the photoreceptor.

TABLE 1

| | Ry μm | Sm μm | Ra μm | Rz μm | Pc | Image quality | UC film thickness measurement | CT film thickness measurement |
|---|---|---|---|---|---|---|---|---|
| Ex. 1 | 1.1 | 20 | 0.13 | 1.0 | 80 | VG | G | G |
| Ex. 2 | 0.8 | 20 | 0.13 | 0.7 | 80 | G | G | G |
| Ex. 3 | 1.4 | 20 | 0.13 | 1.0 | 80 | G | G | G |
| Ex. 4 | 1.1 | 5 | 0.13 | 1.0 | 80 | G | G | G |
| Ex. 5 | 1.1 | 30 | 0.13 | 1.0 | 80 | G | G | G |
| Ex. 6 | 1.1 | 20 | 0.10 | 1.0 | 80 | G | G | G |
| Ex. 7 | 1.1 | 20 | 0.15 | 1.0 | 80 | G | G | G |
| Ex. 8 | 1.1 | 20 | 0.13 | 0.7 | 80 | G | G | G |
| Ex. 9 | 1.4 | 20 | 0.13 | 1.3 | 80 | G | G | G |
| Ex. 10 | 1.1 | 20 | 0.13 | 1.0 | 60 | G | G | G |
| Ex. 11 | 1.1 | 20 | 0.13 | 1.0 | 100 | VG | F | F |
| Com. Ex. 1 | 0.6 | 20 | 0.13 | 0.5 | 80 | P interference fringe | G | G |
| Com. Ex. 2 | 1.6 | 20 | 0.13 | 1.0 | 80 | P black spot | F | F |
| Com. Ex. 3 | 1.1 | 3 | 0.13 | 1.0 | 80 | P interference fringe | F | F |
| Com. Ex. 4 | 1.1 | 40 | 0.13 | 1.0 | 80 | P interference fringe | G | G |
| Com. Ex. 5 | 1.1 | 20 | 0.08 | 1.0 | 80 | P interference fringe | G | G |
| Com. Ex. 6 | 1.1 | 20 | 0.17 | 1.0 | 80 | P interference fringe | F | F |
| Com. Ex. 7 | 1.1 | 20 | 0.13 | 0.5 | 80 | P interference fringe | G | G |
| Com. Ex. 8 | 1.6 | 20 | 0.13 | 1.5 | 80 | P black spot | F | F |
| Com. Ex. 9 | 1.1 | 20 | 0.13 | 1.0 | 40 | P interference fringe | G | G |
| Com. Ex. 10 | 1.1 | 20 | 0.13 | 1.0 | 120 | VG | P | P |
| Com. Ex. 11 | 0.6 | 40 | 0.08 | 0.5 | 40 | VG (600 dpi) | G | G |

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method for producing an electrophotographic photoreceptor in which a charge generating layer and a charge conveying layer, or an underlying layer, a charge generating layer and a charge conveying layer, are formed on a conductive substrate by sequentially coating, the method comprising:

preparing the conductive substrate so as to have a surface roughness caused by a cutting process so that for the surface roughness caused by the cutting process a maximum peak-to-valley roughness height (Ry), centerline average roughness (Ra), the ten-point average roughness (Rz) and average peak-to-peak distance that is an average of the peak-to-peak distance of a cross-sectional curve (Sm) satisfy:

(a) Ry=0.8 to 1.4 μm, (b) Ra=0.10 to 0.15 μm, (c) Rz=0.7 to 1.3 μm, and (d) Sm=5 to 30 μm, and peak count Pc satisfies:

(e)Pc=60 to 100;

sequentially measuring thicknesses of the layers by optical interferometry when the coating is performed to form the layers on the conductive substrate;

feeding back measurement results to controlling means; and controlling an amount of coating by an output from the controlling means in accordance with the measurement results so as to adjust the thicknesses of the layers.

* * * * *